US005671588A

United States Patent [19]

Chan et al.

[11] Patent Number: 5,671,588

[45] Date of Patent: Sep. 30, 1997

[54] METHOD AND APPARATUS FOR APPLYING CARRIERS TO CONTAINERS

[75] Inventors: John Chan, DeSoto, Tex.; Richard L. Chaddock, Huntington Beach, Calif.

[73] Assignee: Owens-Illinois Labels Inc., Toledo, Ohio

[21] Appl. No.: 524,925

[22] Filed: Sep. 8, 1995

[51] Int. Cl.[6] ..... B65B 17/02; B65B 27/04; B65B 55/24

[52] U.S. Cl. ..... 53/398; 53/48.4; 53/141

[58] Field of Search ..... 53/398, 48.4, 48.3, 53/48.1, 141, 580, 158; 134/9, 6

[56] References Cited

U.S. PATENT DOCUMENTS

| | | | |
|---|---|---|---|
| 2,179,831 | 11/1939 | Sedgwick . | |
| 2,824,320 | 2/1958 | Teel . | |
| 2,852,790 | 9/1958 | Bowman . | |
| 2,881,463 | 4/1959 | Vogel . | |
| 3,032,943 | 5/1962 | Reimers et al. . | |
| 3,229,661 | 1/1966 | Shelton . | |
| 3,434,273 | 3/1969 | Lovell . | |
| 3,816,968 | 6/1974 | Morgan et al. | 53/48.1 |
| 3,854,874 | 12/1974 | Loliger et al. | 53/141 X |
| 3,867,807 | 2/1975 | Doucette | 53/48.1 |
| 3,946,535 | 3/1976 | Bourgeois | 53/48.4 X |
| 3,959,949 | 6/1976 | Benno et al. | 53/398 |
| 4,285,185 | 8/1981 | Collura et al. | 53/48.1 |
| 4,354,334 | 10/1982 | Hara | 53/48.4 X |
| 4,392,337 | 7/1983 | Hara | 53/48.1 |
| 4,502,175 | 3/1985 | Hillis | 15/104.92 |
| 4,505,089 | 3/1985 | Osteen | 53/48.1 |
| 4,649,690 | 3/1987 | Schiesz | 53/48.1 |
| 5,235,792 | 8/1993 | Hanagata | 53/141 |
| 5,385,000 | 1/1995 | Bakhtyari | 53/48.3 |

*Primary Examiner*—James F. Coan

[57] ABSTRACT

A method and apparatus for cleaning a strip of carriers for delivery to an apparatus for applying a can carrier to successive groups of cans from a strip of carriers on a roll where the strip is fed from the roll to an applicator comprising a cleaning device interposed between the roll and the applicator. The cleaning device includes opposite cleaning brushes between which the strip of carriers is moved such that dirt, dust and material plate-out is removed from the surfaces of the strip.

14 Claims, 4 Drawing Sheets

FIG. 5
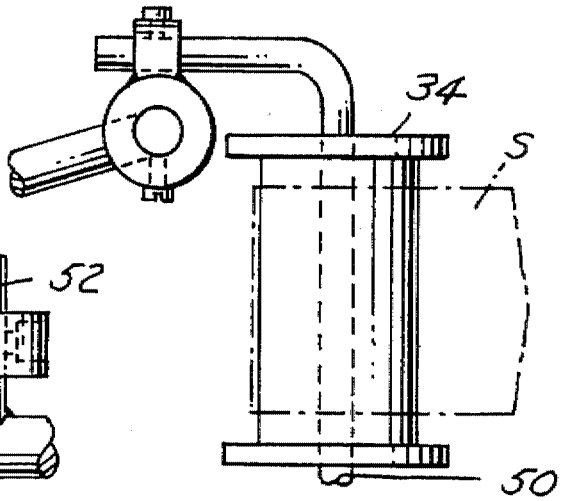
FIG. 6
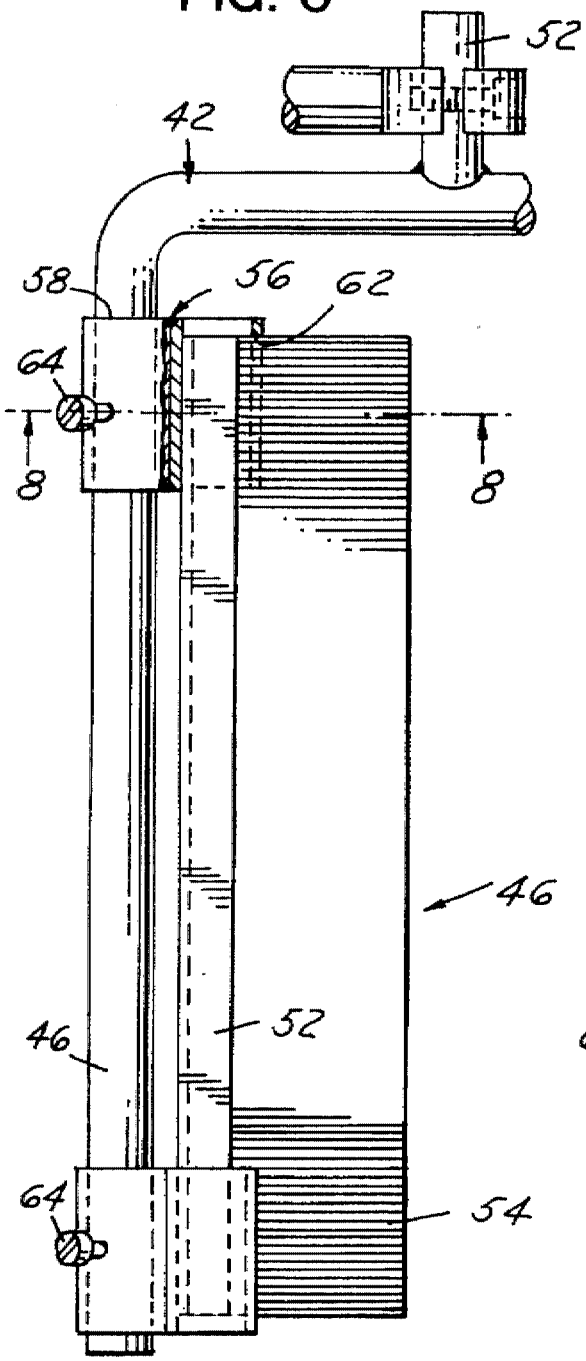
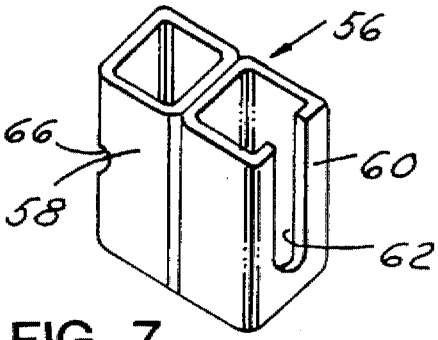
FIG. 7
FIG. 8
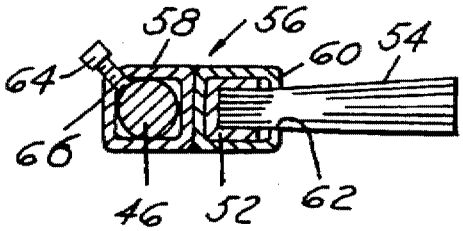

METHOD AND APPARATUS FOR APPLYING CARRIERS TO CONTAINERS

This invention relates to a method and apparatus for applying plastic carriers containers to form a carrier pack.

BACKGROUND AND SUMMARY OF THE INVENTION

In the application of apertured plastic carriers to containers to form a carrier pack, it is common to provide the plastic carriers in a continuous web. The web is normally provided in a roll and an unwinder apparatus delivers the web to the feed drum of an applicator apparatus. Typical patents showing such a construction is U.S. Pat. No. 3,816,968.

One of the problems with respect to the handling of such rolls of plastic carriers is that dust, dirt and material plate-out accumulate on the carrier and contaminates the apparatus as well as the containers. This necessitates stopping the applicator mechanism, cleaning the apparatus which may also have a safety concern because an operator must climb up on a machine to do cleaning. This down time for cleaning decreases production and output.

Among the objectives of the present invention are to provide a method and apparatus which provides for continuous cleaning of the web of carriers; which does not require down time of the applicator system; which improves the housekeeping surrounding the apparatus; which reduces safety concerns for the operator; which reduces the items requiring the attention of the operator; and which increases operating time and production.

In accordance with the invention, the method and apparatus which normally applies the carriers to groups of containers from a strip of carriers on a roll to an applicator apparatus includes the improvement of interposing a cleaning device between the roll and the applicator, providing opposed cleaning means on the device for engaging the surfaces of the web and feeding the strip between the cleaning means before the web passes to the applicator apparatus thereby removing dirt, dust and material plate-out from the surfaces of the strip.

DESCRIPTION OF THE DRAWINGS

FIG. 5 is a fragmentary plan view of a portion of the apparatus shown in FIGS. 2–4.

FIG. 6 is a fragmentary plan view on an enlarged scale of another portion of the apparatus.

FIG. 7 is a perspective view of a brush mounting bracket.

FIG. 8 is a sectional view taken along the line 8—8 in FIG. 6.

DESCRIPTION

Figure 1:
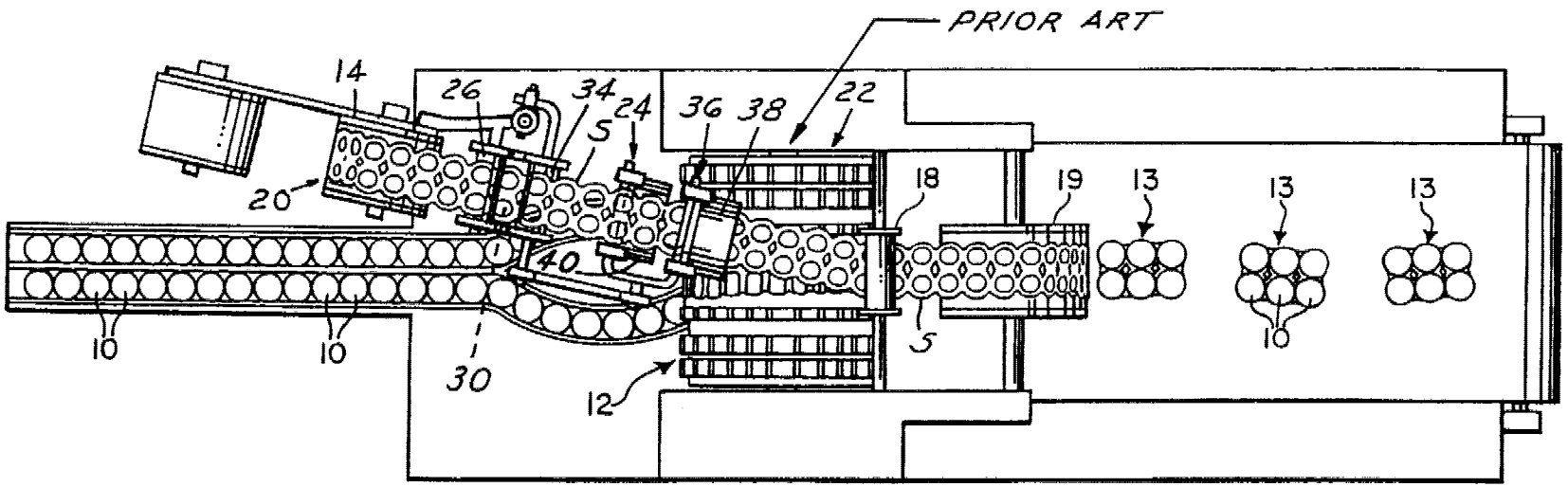
FIG. 1 is a plan view of the invention as applied to the prior art apparatus to which the invention is directed.
Figure 2:
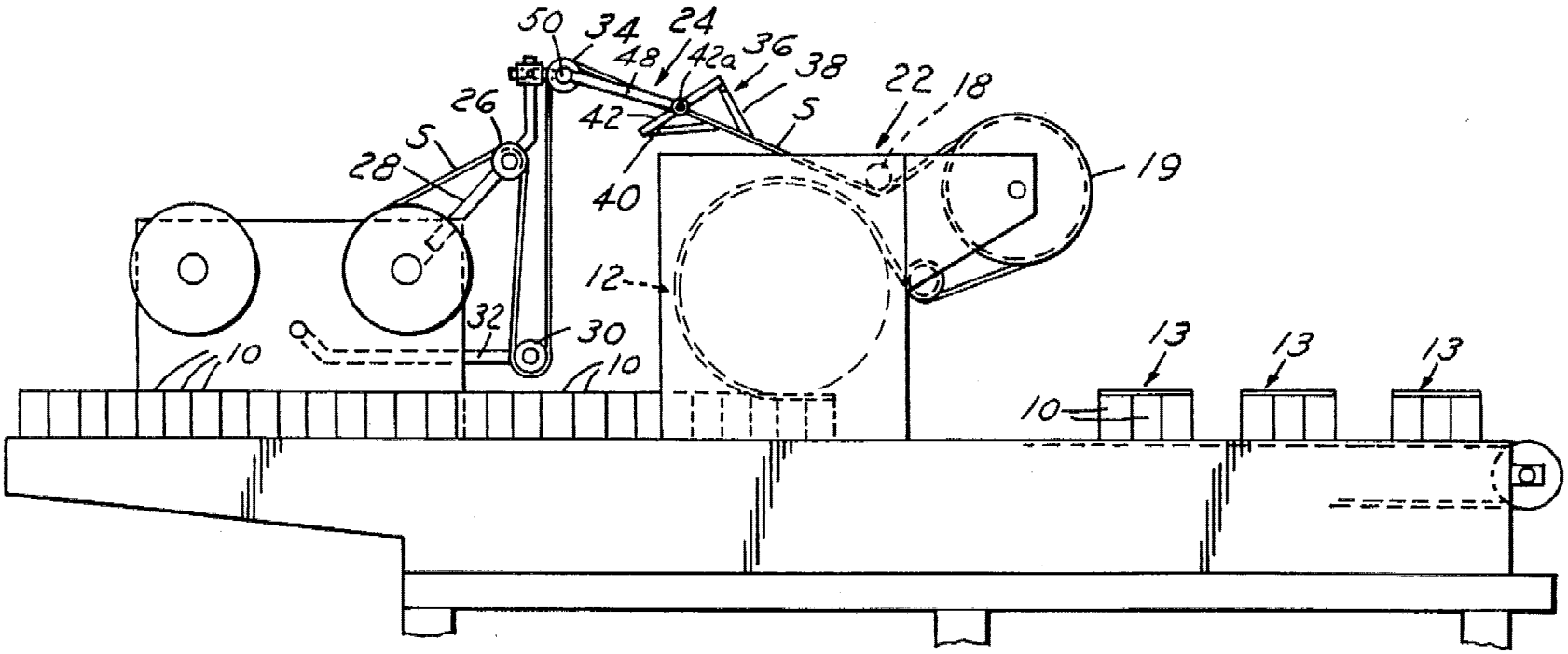
FIG. 2 is an elevational view of the apparatus embodying the invention.
Figure 3:
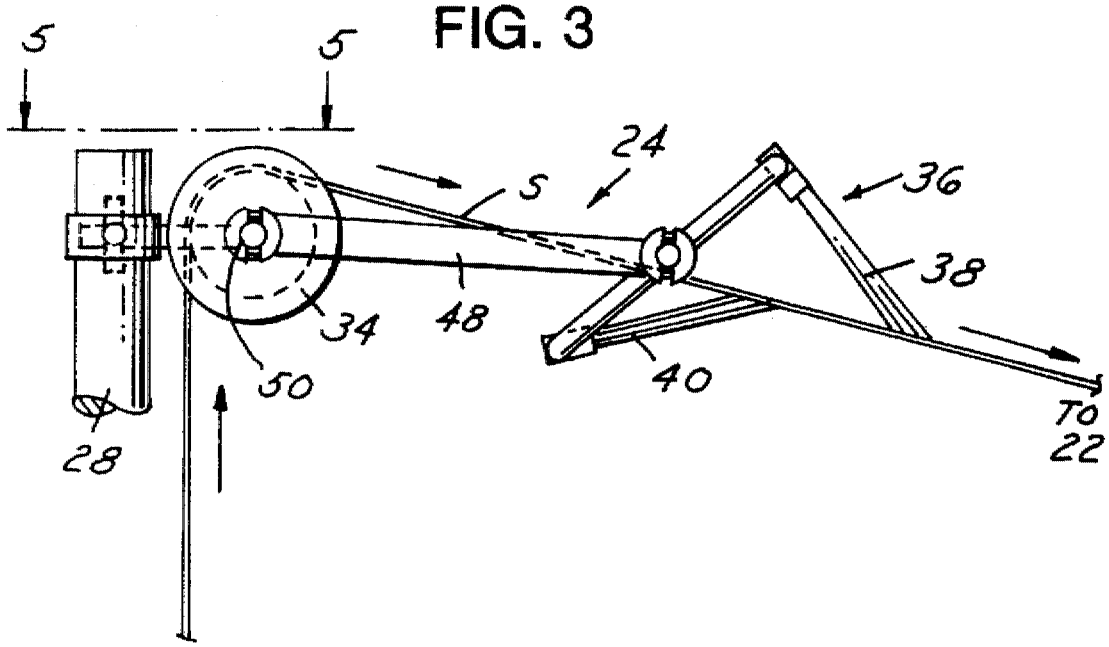
FIG. 3 if a fragmentary view on an enlarged scale of the apparatus shown in FIG. 2.
Figure 4:
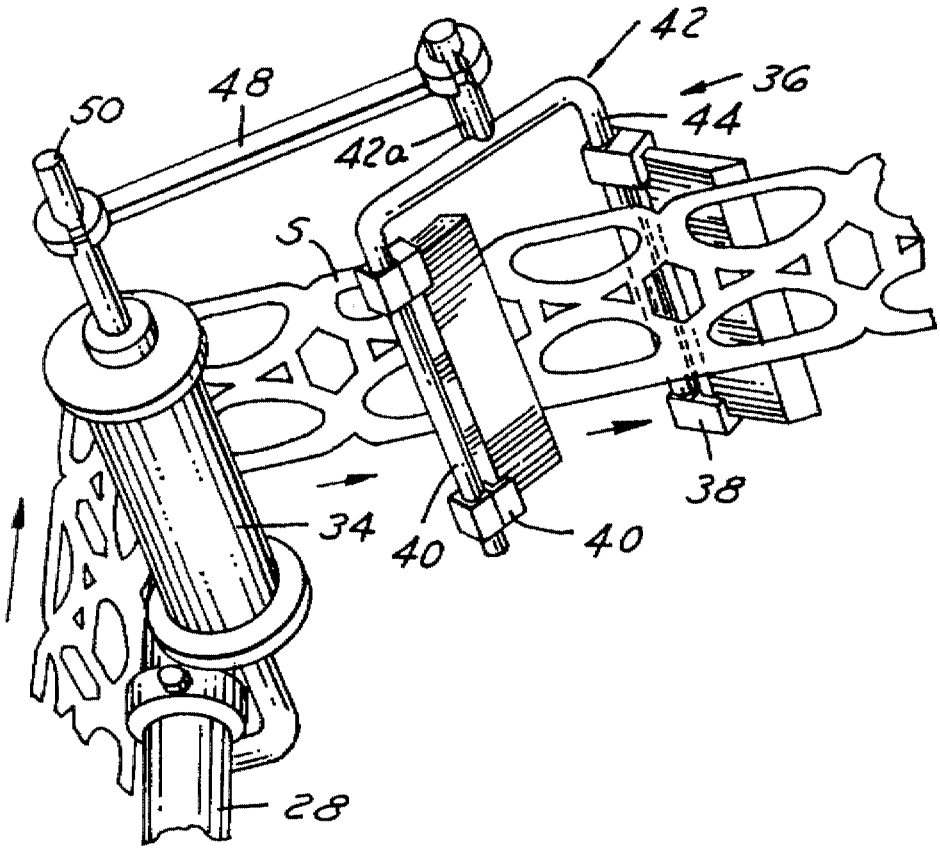
FIG. 4 is a fragmentary perspective view of a portion of the apparatus shown in FIG. 3.

Referring to FIG. 1, the present invention is directed to the cleaning of the strip or web as the strip moves from an unwinder apparatus 20 to an applicator apparatus 22. In such an apparatus, containers 10 are supplied in rows by a conveyor, for example in two rows. The containers 10 are directed beneath the drum assembly 12 of the applicator apparatus. Carrier stock S comprising a row of interconnected carriers is supplied from a reel 14 to the drum assembly 12 by rollers 18, 19. The carrier strip S is received by jaws on the drum assembly which stretch the strip and applies the carriers successively on the groups of containers. This apparatus may be of the type shown in U.S. Pat. No. 3,816,969 wherein the strip is gripped along its sides and stretched over the container, incorporated herein by reference.

In accordance with the invention, a cleaning apparatus 24 is interposed between the unwinder apparatus 20 and the applicator apparatus 22. This cleaning apparatus 24 receives the strip S which has passed over an upper idler 26 on a fixed arm 28, a roller 30 on a dancer arm 32 and an idler roller 34 rotatably mounted on the fixed arm 28. The strip S then passes through cleaning means 36 which functions to remove dirt, dust and material plate out from the plastic of the strip S.

The cleaning means 36 preferably comprises an upper brush 38 and a lower brush 40 supported in adjustable position on a U-shaped bracket 42. The bracket 42 includes an upper arm 44 which supports upper brush 38 and a lower arm 46 which supports lower brush 40. The bracket 42 is adjustably mounted angularly with respect to the axis of the idler roller 32 by an arm 48 which has one end adjustably position on shaft 50 which rotatably supports the idler roller 32. The other end of arm 48 is adjustably positioned on a post **42*a* on bracket 42 and parallel to arms 44, 46**.

The upper brush 38 and the lower brush 40 are identical in construction and comprises a body 52 and a row of bristles 54 extending from the body 52. Each brush 38, 40 is rotatably adjustable on its respective arm 44, 46. Referring to FIGS. 6–8, brush 46 is adjustable rotatably by spaced bracket assemblies 56 which includes two side-by-side rectangular tubes 58, 60. The brush 46 is inserted tube 60 and the bristles extend through slots 62 of tubes 60. Arm 46 extends through tubes 58 and is held in any desired position by set screws 64 which extend through openings 66.

It can thus be seen that there has been provided a method and apparatus which provides for continuous cleaning of the strip of carriers; which does not require down time of the applicator system; which improves housekeeping surrounding the apparatus; which reduces safety concerns for the operator; which reduces items requiring the attention of the operator; and which increases operating time and production.

We claim:

1. In an apparatus for applying a can carrier to successive groups of cans from a strip of carriers on a roll where the strip is fed from the roll to an applicator, the improvement comprising a cleaning device interposed between said roll and said applicator, said cleaning device including opposite cleaning means between which the strip of carriers is moved such that dirt, dust and material plate-out is removed from the surface of said strip, said cleaning means comprises an upper brush and a lower brush, and and means for adjusting the position and the angle of said brushes with respect to said strip of carriers.

2. The apparatus set forth in claim 1 wherein said means for adjusting the position and angle of said brushes comprises bracket means for adjusting the angle of said brushes with respect to an axis transverse to said strip.

3. The apparatus set forth in claim 2 including means for changing the angle of said brushes with respect to said axis.

4. In method for applying a can carrier to successive groups of cans from a strip of plastic carriers on a roll where the strip is fed from the roll to an applicator which applies the plastic carrier to containers wherein dust, dirt and material plate-out tend to accumulate on the container and contaminate the applicator, the improvement comprising interposing a cleaning device between the roll and the applicator, providing opposed cleaning means on said device, feeding the strip of carriers between said cleaning means before it passes to the applicator such that dirt, dust and material plate-out is removed from the surfaces of said strip.

5. The method set forth in claim 4 including providing said cleaning means with an upper brush and a lower brush.

6. The method set forth in claim 5 including adjusting the angle and position of each said brush.

7. The method set forth in claim 6 including the step of positioning said brushes such that they extend transversely to the direction of movement of said strip of carriers.

8. The method set forth in claim 7 including the step of adjusting the position of the angle of said brushes with respect to the strip of carriers.

9. The method set forth in claim 8 wherein said step of adjusting the position and angle of such brushes comprises adjusting the angle of said brushes with respect to an axis transverse to said strip.

10. In an apparatus for applying a can carrier to successive groups of cans from a strip of plastic carriers on a roll where the strip is fed from the roll to an applicator applies the plastic carriers to containers wherein dust, dirt and material plate-out tend to accumulate on the container and contaminate the applicator, the improvement comprising a cleaning device interposed between said roll and said applicator, said cleaning device including opposite cleaning means between which the strip of carriers is moved such that dirt, dust and material plate-out is removed from the surface of said strip.

11. The apparatus set forth in claim 10 wherein said cleaning means comprises an upper brush and a lower brush.

12. The apparatus set forth in claim 11 including means for adjusting the position and the angle of said brushes with respect to said strip of carriers.

13. The apparatus set forth in claim 12 wherein said means for adjusting the position and angle of said brushes comprises bracket means for adjusting the angle of said brushes with respect to an axis transverse to said strip.

14. The apparatus set forth in claim 13 including means for changing the angle of said brushes with respect to said axis.

* * * * *